US010060621B2

(12) United States Patent
Min et al.

(10) Patent No.: US 10,060,621 B2
(45) Date of Patent: Aug. 28, 2018

(54) GAS-AIR MIXING DEVICE FOR COMBUSTOR

(71) Applicant: KYUNGDONG NAVIEN CO., LTD., Pyeongtaek-si, Gyeonggi-do (KR)

(72) Inventors: Myoung Gee Min, Seoul (KR); Dae Hyun Kim, Pyeongtaek-si (KR)

(73) Assignee: KYUNGDONG NAVIEN CO., LTD., Pyeongtaek-si, Gyeonggi-do (KR)

( * ) Notice: Subject to any disclaimer, the term of this patent is extended or adjusted under 35 U.S.C. 154(b) by 700 days.

(21) Appl. No.: 14/377,168

(22) PCT Filed: Jan. 16, 2013

(86) PCT No.: PCT/KR2013/000340
§ 371 (c)(1),
(2) Date: Aug. 6, 2014

(87) PCT Pub. No.: WO2013/118979
PCT Pub. Date: Aug. 15, 2013

(65) Prior Publication Data

US 2015/0050608 A1 Feb. 19, 2015

(30) Foreign Application Priority Data

Feb. 6, 2012 (KR) ..... 10-2012-0011642

(51) Int. Cl.
*F23C 7/00* (2006.01)
*F23D 14/02* (2006.01)
*F23D 14/62* (2006.01)

(52) U.S. Cl.
CPC ..... *F23D 14/02* (2013.01); *F23D 14/62* (2013.01); *F23N 2037/10* (2013.01)

(58) Field of Classification Search
CPC . F23D 14/02; F23D 14/62; F16K 1/24; F16K 1/12
(Continued)

(56) References Cited

U.S. PATENT DOCUMENTS 2,402,208 A * 6/1946 Read ..... F02D 9/1015 251/305
2,434,085 A * 1/1948 Suggs ..... B64D 33/10 123/41.59
(Continued)

FOREIGN PATENT DOCUMENTS

FR 2079112 A5 * 11/1971 ..... F23D 14/60
JP 53-24141 A1 3/1978
(Continued)

OTHER PUBLICATIONS

English Translation of FR 2079112 A5.*

*Primary Examiner* — Jason Lau
(74) *Attorney, Agent, or Firm* — Novick, Kim & Lee, PLLC; Jae Youn Kim

(57) ABSTRACT

Provided is a gas-air mixing device for a combustor which effectively controls the amount of gas and air supplied to a burner provided in a combustor, such as a boiler or a water heater, thus improving the turn-down ratio which leads to increased convenience for using hot water and heat and enhanced durability of the burner. The gas-air mixing device for a combustor comprises: a housing, connected on one side to a turbo fan; a discharge part disposed on one side of the housing and in contact with the turbo fan; first and second air supply parts, provided on the other side of the discharge part and separated by a first partition; first and second gas supply parts, separated by a second partition; and an opening/closing means for controlling the flow of gas and air by opening or blocking the second air supply part and the second gas supply part.

7 Claims, 3 Drawing Sheets

(58) Field of Classification Search
USPC ..... 431/187
See application file for complete search history.

(56) References Cited

U.S. PATENT DOCUMENTS

| | | | | |
|---|---|---|---|---|
| 4,465,456 | A * | 8/1984 | Hynek | F23N 1/025 137/98 |
| 4,572,134 | A * | 2/1986 | Nouthuka | F02M 7/20 123/438 |
| 6,604,938 | B1 | 8/2003 | Blaauwwiekel et al. | |
| 9,364,799 | B2 * | 6/2016 | Son | B01F 3/028 |
| 2003/0013057 | A1 | 1/2003 | Vegter | |
| 2011/0139045 | A1 | 6/2011 | Zatti et al. | |

FOREIGN PATENT DOCUMENTS

| | | | | |
|---|---|---|---|---|
| JP | 08-075155 | A | 3/1996 | |
| JP | 2002-122324 | A | 4/2002 | |
| KR | 10-0371208 | B1 | 2/2003 | |
| KR | 10-0805630 | B1 | 2/2008 | |
| KR | 10-2012-0109966 | A | 10/2012 | |
| WO | WO 2012007823 | A1 * | 1/2012 | F23D 14/02 |

* cited by examiner

GAS-AIR MIXING DEVICE FOR COMBUSTOR

TECHNICAL FIELD

The present invention relates to a gas-air mixing device for a combustor, and more specifically to a gas-air mixing device for a combustor which effectively controls the amount of gas and air supplied to a burner provided in a combustor, such as a boiler or a water heater, thus improving the turn-down ratio which leads to increased convenience for using hot water and heat and enhanced durability of the burner.

BACKGROUND OF THE INVENTION

In general, combustors used for hot water and heating, such as a boiler or a water heater, are classified into an oil boiler, a gas boiler, an electric boiler and a water heater depending on the fuel it is supplied with, and are diversely developed to fit different installation usages.

Among these combustors, in particular, the gas boiler and the water heater generally use a Bunsen Burner or a Premixed Burner to combust gas fuel, and among these the combustion method of the premixed burner is carried out by mixing gas and air with mixing ratio of combustion optimum state and supplying this mixture (air+gas) to a burner port for combustion.

The function of a combustor is evaluated by the turn-down ratio (TDR). A turn-down ratio refers to a ratio of maximum gas consumption versus minimum gas consumption in a gas combustion device in which the gas volume is variable regulated. For instance, if the maximum gas consumption is 24,000 kcal/h and the minimum gas consumption is 8,000 kcal/h, the turn-down ratio is 3:1. The turn-down ratio is controlled according to the ability to maintain a stable flame under the minimum gas consumption condition.

In the gas boiler and the water heater, convenience of using hot water and heat increases with larger turn-down ratio. That is, if the turn-down ratio is small (meaning the minimum gas consumption is high) and the burner is activated for a small load volume of the heating water and heat, frequent On/Off of the combustor occurs, thereby deviation during temperature control increases and durability of the apparatus decreases. Therefore, various methods have been developed to increase the turn-down ratio applied to a combustor in order to improve aforementioned problems.

Valves which supply gas to these types of burners with proportional control are largely divided into electrical modulating gas valve, which is controlled by current value, and pneumatic modulating gas valve, which is controlled by differential pressure generated during air supply.

In the pneumatic modulating gas valve, the amount of gas supplied to the burner is controlled using a fan by differential pressure generated according to air supply needed for combustion in the burner. At this time, the air and gas needed for combustion are mixed in the gas-air mixer and supplied to the burner as a mixture (air+gas).

In a gas-air mixing device of a gas burner using such pneumatic modulating gas valve, the primary factor controlling the turn-down ratio is the relationship between gas consumption (Q) and differential pressure (ΔP). The common relationship between fluid pressure and flow rate is as follows:

$$Q=k\sqrt{\Delta P}$$

As shown in the above formula, differential pressure needs to be quadrupled in order to double fluid flow rate.

Therefore, differential pressure ratio must be 9:1 in order to have a turn-down ratio of 3:1, and the differential pressure ratio needs to be 100:1 to have a turn-down ratio of 10:1. However, it is impossible to infinitely increase the gas feed pressure.

In order to solve the above problem, the present invention describes, as illustrated in FIG. 1, a device for increasing the turn-down ratio of the gas burner by dividing the gas and air supply paths into two or more sections, respectively, and opening/closing each passage of gas injected into the burner.

PRIOR ART

Patent Literature (Patent Literature 1) Korean Patent Application No. 10-2011-84417

The patent literature is a previously filed application by the applicant of the present invention and is directed to a gas-air mixer with a separable passage. Referring to FIG. 1, a gas supply pipe (112) that is divided into two parts is connected to one side of the air supply pipe (113), and a separate branching mechanism (170) is provided inside the air supply pipe (113). As a result, a valve body (161, 162) opens and blocks a gas passage (116) and an air passage (118) via the up and down motion of a rod (163) connected to an electromagnet (165), through which the minimum output mode and the maximum output mode can be controlled, to improve the turn-down ratio.

However, aforementioned up and down motion of the rod (163) in the air passage (118) has a long range, which increases stroke, resulting in increased driving time and driving distance.

Also, since a separate branching mechanism (170) is interposed in the air passage (118), manufacturing is inconvenient and detachment is difficult when the apparatus is broken.

DISCLOSURE OF INVENTION

Technical Problem

The present invention has been made to solve the above-described problem occurring in the prior art, and an object of the present invention is to provide a gas-air mixing device for a combustor which can increase the turn-down ratio by controlling the amount of air and gas through relatively short driving distance of the opening/closing means, which controls the amount of gas and air supplied to a combustor, such as a boiler or a water heater.

Technical Solution

The present invention, which aims to solve the above-described problem comprises, a housing connected on one side to a turbo fan and is provided with a space of a predetermined size in the interior thereof through which gas and air can flow; a discharge part is disposed on one side of the housing and is in contact with the turbo fan; first and second air supply parts, provided on the other side of the discharge part for intake of outside air, and are separated by a first partition; first and second gas supply parts, separated by a second partition, for supplying gas which mixes with air flowing in from the first and second air supply parts and is discharged via the discharge part; and an opening/closing means for blocking the flow of gas and air by closing the second air supply part and the second gas supply part when in low-output mode, and for opening the second air supply part and the second gas supply part to allow gas and air flow when in a high-output mode.

In one embodiment, the opening/closing means comprises a plate-shaped valve body which blocks gas entry by being in contact with the upper portion of the second gas supply part; a plunger connected to the valve body surface by a hinge; and a solenoid valve that is connected to the plunger and controls the up and down motion of the plunger by an electric signal, to open and close the valve body.

In one embodiment, the present invention is characterized by having a protruding support which allows the valve body to be supported when ascending by being in contact with the upper inner surface of the housing.

In one embodiment, the present invention is characterized by having an inclined section at the second gas supply part, in which the end is protruding and is inclined at a fixed angle to keep the flow directions of the gas and air the same, thereby allowing easy mixing of the gas and air simultaneously with minimization of the stroke of the opening/closing means.

Advantageous Effects

Using the gas-air mixing device for a combustor according to the present invention, first, turn-down ratio can be increased to regulate the amount of gas and air required for the combustor at a larger range. Thus, fine heat control is possible during change in flow and also variation range of the hot water temperature can be reduced.

Second, solenoid valve with a simple structure of the driving part and excellent durability is used, and the connection between the solenoid valve and valve body (damper shape) connected thereto is protruded at a predetermined angle, thereby the stroke of the solenoid valve can be reduced simultaneously with minimizing failure rate of the solenoid valve.

Third, the gas and air are structured to flow in through a single body, thereby it is easy to repair damages and manufacturing cost can be minimized.

DESCRIPTION OF THE PREFERRED EMBODIMENTS

Figure 1:
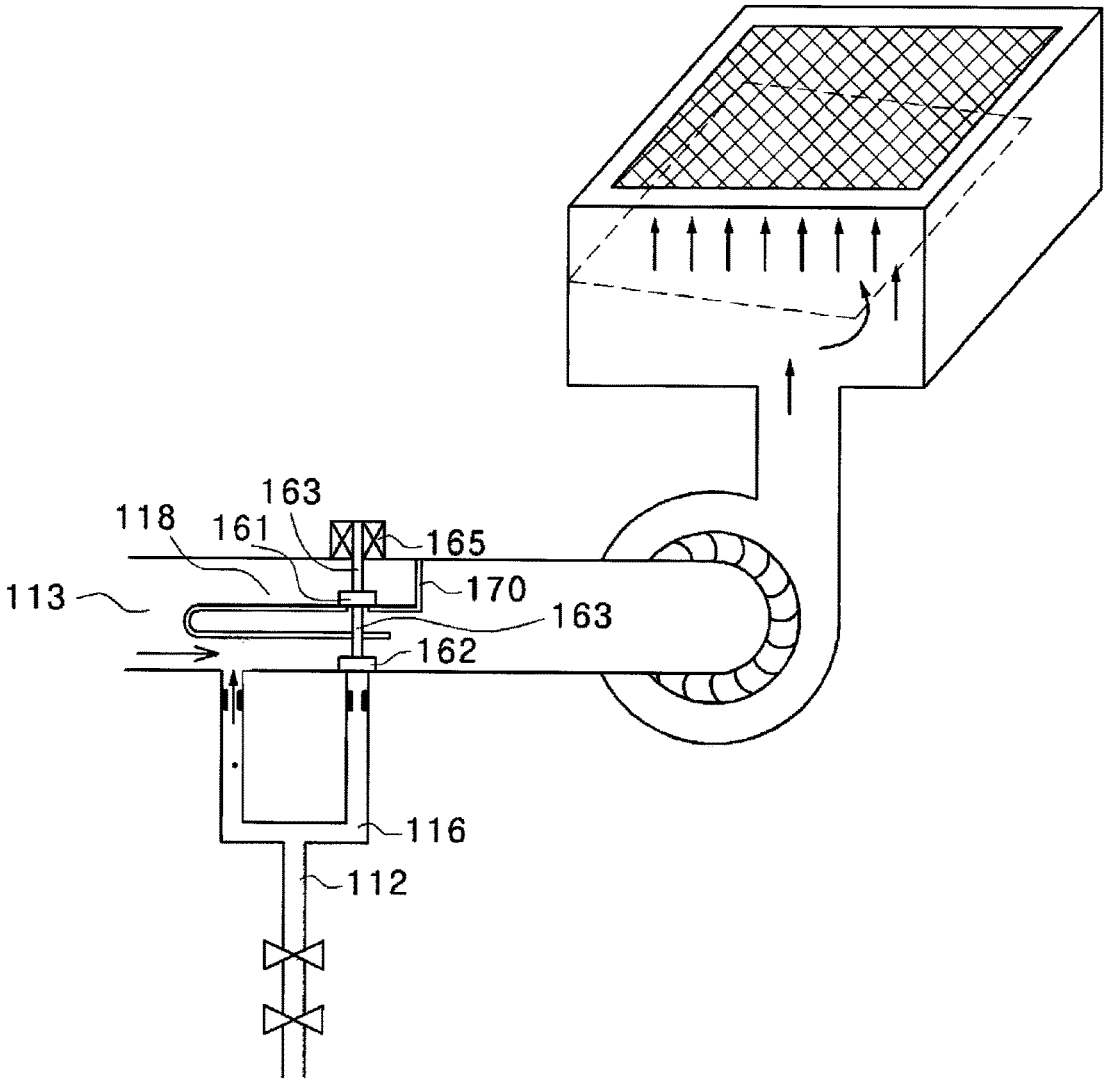
PRIOR ART FIG. 1
FIG. 1 is a graph showing prior art.

Hereinafter, exemplary embodiment of the present invention will be described with reference to the accompanying drawings. The embodiment of the present invention can be modified into various forms, and it should be understood that the scope of the present invention is not limited to the embodiment whose detailed description is provided below. The following embodiment is given to provide a more detailed description of the present invention to those skilled in the art. Therefore, shapes of the elements may be exaggerated in the drawings for a clearer understanding of the description. Identical or corresponding elements in each drawing may be designated with the same reference signs. In addition, description of known functions or configurations determined to hinder the understanding of the present invention are omitted.

Hereafter, an exemplary embodiment of the gas-air mixing device for a combustor will be described in detail with reference to the accompanying drawings.

Figure 2:
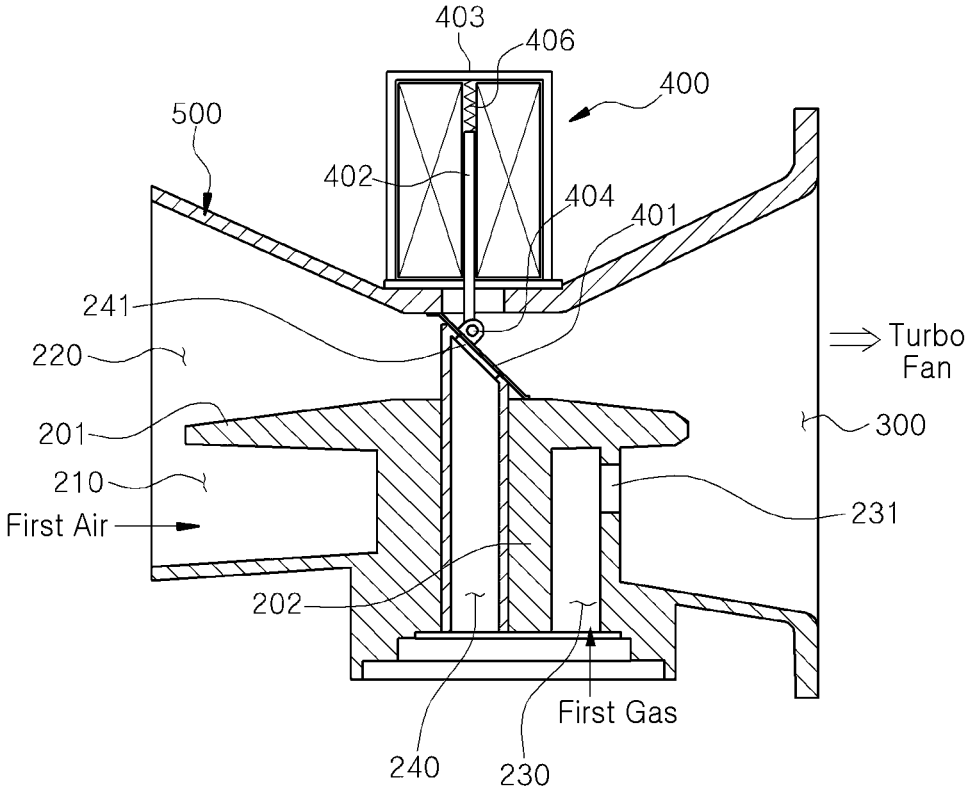
FIG. 2 is a sectional view showing the gas-air mixing device for a combustor according to the present invention.
Figure 3:
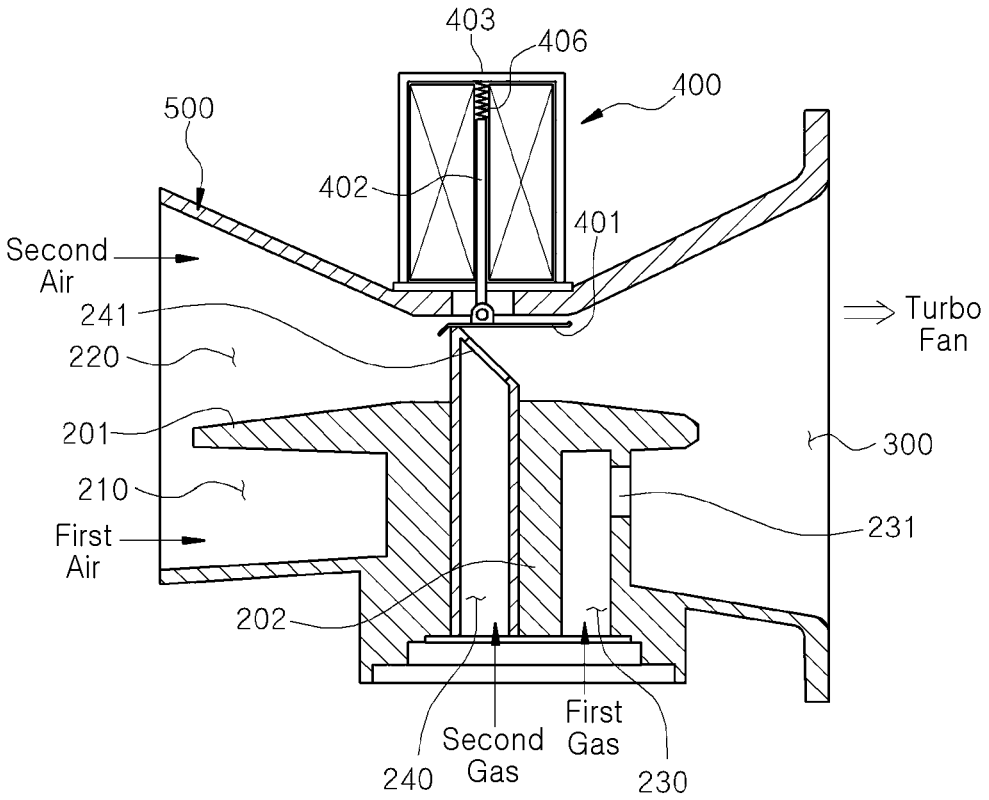
FIG. 3 is a sectional view of the operating state of FIG. 2.
Figure 4:
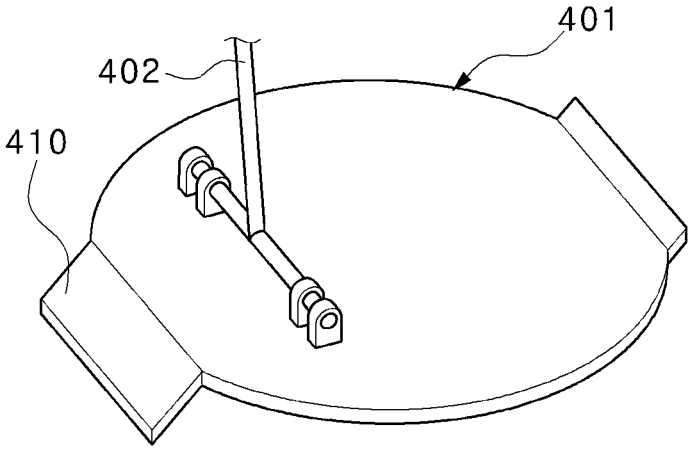
FIG. 4 is a perspective view showing the valve body of FIG. 2.

In the accompanying drawings, FIG. 2 is a sectional view showing the gas-air mixing device for a combustor according to the present invention, FIG. 3 is a sectional view of the operating state of FIG. 2, and FIG. 4 is a perspective view showing the valve body of FIG. 2.

Referring to FIG. 2 and FIG. 4, the gas-air mixing device for a combustor of the present invention comprises a housing (500) that is connected to a turbo fan on one side and is provided with a predetermined space therein through which gas and air can flow. Further, the housing (500) is provided with a discharge part (300) on one side through which mixed gas, that is a mixture of air and gas, is discharged. The discharge part (300) is in contact with the turbo fan (not shown) such that the mixed gas, that is a mixture of air and gas, supplied from the first and second air supply parts (210, 220) and the first and second gas supply parts (230, 240) are transmitted to the burner by the turbo fan.

The other side of the housing 500 suctions air and is divided by a first partition (201), thereby forming a cylindrically shaped first air supply part (210) at the lower portion and a second air supply part (220) at the upper portion.

Gas is supplied to the central lower portion between the second air supply part (220) and the discharge part (300), and is divided by a second partition (202) such that a first gas supply part (230) is formed on the right side and a second gas supply part (240) is formed on its left side in a cylindrical shape. The second gas supply part (240) is provided with an inclined section (241) which has a protruding end that is inclined at an angle, such that the flow direction of the second gas and air are the same, to allow for easy mixing simultaneously with minimization of the stroke of the opening/closing means (400). The inclined section (241) has a discharge hole, through which the second gas is discharged, and the inclined surface of the inclined section (241) is placed in the direction of the discharge part (300).

The inclined section (241) is in contact with a valve body (401), which configures the opening/closing means (400) to be described hereafter, for opening or closing inflow of second gas and second air.

Hereafter, the opening/closing means (400) for controlling the inflow of air and gas of the second air supply part (220) and the second gas supply part (240) will be described in detail.

The opening/closing means (400) comprises a plate-shaped valve body (401) that is in contact with the upper inclined section (241) of the second gas supply part (240) to block gas and air entry, a plunger (402) connected to the surface of the valve body (401) by the hinge (404), and a solenoid valve (403) that is connected to the plunger (402) and allows opening and closing of the valve body (401) by causing up and down motion of the plunger (402). In particular, the plunger (402) ascends by the electrical signal transmitted to the solenoid valve (403) and if the electrical signal is blocked, the plunger (402) descends by elasticity of a spring (406) placed in the inner surface.

Meanwhile, the valve body (401) forms a protruding support (410) which allows the valve body (401) to be supported by being in contact with the upper inner surface of the housing (500) when ascending.

Hereafter, the operating state of the gas-air mixing device for a combustor of the present invention configured as above will be described in detail.

As illustrated in FIG. 2, the valve body (401) of the opening/closing means (400) comes into contact with the second gas supply part (240) during a low output mode, causing the first gas and air to be mixed only at the first air supply part (210) and the first gas supply part (230) to then flow into the turbo fan. Here, the first gas is discharged through a through-hole (231) formed on the first gas supply part (230).

Subsequently, at high output mode as shown in FIG. 3, the plunger (402) operates when electricity is supplied to the solenoid valve (403), thus allowing the plunger to ascend by overcoming force of the spring (406). As a result, the valve body (401) is rotated upwards by the hinge (404) which opens the second air supply part (220) and the second gas supply part (240), causing the second air and gas to flow into the housing (500).

If the mode is switched back to the low output mode, as shown in FIG. 2, the plunger descends when electricity is blocked to the solenoid valve (403) due to elasticity of the spring (406). Consequently, the valve body (401) is rotated downwards by the hinge (404), which blocks the second air supply part (220) and the second gas supply part (240), causing the second air and gas to be blocked.

Here, one end of the valve body (401) is provided with a protruding support (410), allowing it to be supported on the inner surface of the housing (500) when the plunger (402) ascends, to allow the valve body (401) to ascend easily.

The above description relating to a preferred embodiment of a gas-air mixing device for a combustor according to the present invention is merely an example. It will be understood by the skilled person in the art that various modifications and other similar embodiments based on the description provided can be made. Therefore, it is clear that the present invention is not limited to the referred embodiment described above. Accordingly, the scope of the invention to be protected must be based on the technical principles of the accompanying claims. Further, it must be understood that various modifications, additions and substitutions are possible, without departing from the scope and spirit of the invention as disclosed in the accompanying claims.

REFERENCE SIGNS

201: First Partition 202: Second Partition
210: First Air Supply Part 220: Second Air Supply Part
230: First Gas Supply Part 240: Second Gas Supply Part
300: Discharge Part 400: Opening/Closing Means
401: Valve Body 402: Plunger
403: Solenoid Valve 404: Hinge
406: Spring 410: Support

The invention claimed is:

1. A gas-air mixing device for a combustor, comprising:

a housing connected on one side to a fan and provided with a space of a predetermined size in an interior thereof through which gas and air can flow;

a discharge part disposed on an output side of the housing;

a first air supply part and a second air supply part, both located on an input side of the housing and separated by a first partition, wherein the first air supply part supplies a first air, and wherein the second air supply part supplies a second air;

a first gas supply part and a second gas supply part separated by a second partition, wherein the first gas supply part provides a first gas for mixing with the first air, and the second gas supply part provides a second gas for mixing with the second air; and a solenoid assembly including:

a plunger; and a valve body including a center plate, a first protruding support connected to a first side edge of the center plate and a second protruding support connected to a second side edge of the center plate, wherein the first side edge is located opposite to the second side edge of the center plate, and wherein the first and second protruding supports are bent downward and upward respectively with respect to a plane of the center plate and configured to operatively come into contact with an inner upper surface of the second air supply part of the housing and an upper surface of the second partition respectively so as to selectively open the second gas and air supply parts, wherein the valve body is configured to simultaneously close the second air and the second gas by rotating into a closed position when the solenoid assembly is in a low output mode, wherein the valve body is configured to simultaneously open the second air and the second gas by rotating into an open position when the solenoid assembly is in a high output mode, wherein the second gas supply part includes an inclined section at an end configured to reduce a stroke distance of the plunger, and wherein the valve body is configured to rotate and to fit onto the inclined section of the second gas supply part when the solenoid assembly changes from the high output mode into the low output mode.

2. The gas-air mixing device for the combustor as claimed in claim 1, wherein the plunger is connected to a surface of the valve body by a hinge, and wherein the solenoid assembly further comprises a solenoid valve connected to the plunger causing opening and closing of the valve body by controlling an up and down motion of the plunger through an electrical signal.

3. The gas-air mixing device for the combustor as claimed in claim 1, wherein the inclined section is located at a protruding end of the second gas supply part and is configured to cause the flow directions of the second gas and the second air to be same, thereby facilitating a mixture of the second gas and the second air simultaneously while reducing the stroke distance of the plunger.

4. The gas-air mixing device for the combustor as claimed in claim 2, wherein the inclined section is located at a protruding end of the second gas supply part and is configured to cause the flow directions of the second gas and the second air to be same, thereby facilitating a mixture of the second gas and the second air simultaneously while reducing the stroke distance of the plunger.

5. A gas-air mixing device for a combustor, comprising, a housing;

a discharge part disposed on an output side of the housing;

a first air supply part and a second air supply part, both located on an input side of the housing and separated by a first partition, wherein the first air supply part supplies a first air, and wherein the second air supply part supplies a second air;

a first gas supply part and a second gas supply part separated by a second partition, wherein the first gas supply part provides a first gas for mixing with the first air, the second gas supply part provides a second gas for mixing with the second air, and the second gas supply part includes an inclined section at an upper end;

a solenoid assembly including:

a solenoid valve;

a plunger having a plunger axis;

a valve body including a center plate, a first protruding support connected to a first side edge of the center plate and a second protruding support connected to a second side edge of the center plate, wherein the first side edge is located opposite to the second side edge of the center plate, and wherein the first and second protruding supports are bent downward and upward respectively with respect to a plane of the center plate and configured to operatively come into contact with an inner upper surface of the second air supply part of the housing and an upper surface of the second partition respectively so as to selectively open the second gas and air supply parts; and a hinge having a hinge axis that is perpendicular to the plunger axis, wherein the hinge connects the plunger to the valve body such that the valve body freely rotates about the hinge axis, wherein the solenoid assembly is configured to close the second gas in a low output mode by lowering the plunger and rotating the valve body onto the inclined section of the second gas supply part, and wherein the solenoid assembly is configured to open the second gas in a high output mode by raising the plunger and rotating the valve body away from the inclined section of the second gas supply part.

6. The gas-air mixing device of claim 5, wherein the second gas supply part has a second gas supply part axis that is parallel with the plunger axis.

7. The gas-air mixing device of claim 2, wherein the hinge is located off a center of the valve body.

* * * * *